US010837129B2

(12) United States Patent
Rovellini

(10) Patent No.: US 10,837,129 B2
(45) Date of Patent: Nov. 17, 2020

(54) APPARATUS FOR STRETCHING ACRYLIC FIBRES TOWS IN A PRESSURISED STEAM ENVIRONMENT

(71) Applicant: M.A.E. S.p.A., Piacenza (IT)

(72) Inventor: Marco Rovellini, Piacenza (IT)

(73) Assignee: M.A.E. S.p.A., Piacenza (IT)

( * ) Notice: Subject to any disclaimer, the term of this patent is extended or adjusted under 35 U.S.C. 154(b) by 313 days.

(21) Appl. No.: 15/736,657

(22) PCT Filed: Jun. 8, 2016

(86) PCT No.: PCT/IB2016/053350
§ 371 (c)(1),
(2) Date: Dec. 14, 2017

(87) PCT Pub. No.: WO2016/203345
PCT Pub. Date: Dec. 22, 2016

(65) Prior Publication Data

US 2018/0148867 A1 May 31, 2018

(30) Foreign Application Priority Data

Jun. 16, 2015 (IT) ..... 102015000023930

(51) Int. Cl.
*D02J 1/22* (2006.01)
*D02J 13/00* (2006.01)
*D01D 5/12* (2006.01)

(52) U.S. Cl.
CPC ..... *D02J 1/222* (2013.01); *D01D 5/12* (2013.01); *D02J 1/225* (2013.01); *D02J 13/001* (2013.01)

(58) Field of Classification Search
CPC .. D02J 1/222; D02J 1/228; D02J 1/225; D02J 1/226; D02J 13/00; D02J 13/001; D06B 5/02; D06B 23/16; D01D 5/12; D01D 5/14
USPC ..... 28/240–246
See application file for complete search history.

(56) References Cited

U.S. PATENT DOCUMENTS 3,484,949 A * 12/1969 Aronoff ..... D06C 5/00 34/635
3,971,235 A * 7/1976 Frezza ..... D06C 5/00 68/5 E
4,183,151 A * 1/1980 Frezza ..... D06C 5/00 26/81

(Continued)

FOREIGN PATENT DOCUMENTS

DE 26 23 671 A1 12/1976
WO 2014/188341 11/2014

*Primary Examiner* — Jillian K Pierorazio
(74) *Attorney, Agent, or Firm* — Bay State IP, LLC

(57) ABSTRACT

A stretching apparatus of fibre tows in a pressurized steam environment comprises a plurality of stretching chests (1) and associated supporting structures (3, 4, 6) arranged side by side, at the same level, on a holding frame. The stretching chests (1) are each formed by two opposed metallic half-chests (1*b*, 1*t*), delimiting a stretching chamber (2). The stretching chamber (2) has a generally rectangular section of a low height and opens outwards in correspondence of the two transversal edges of the stretching chest (1) through tow entry and exit openings. Inside the stretching chambers (2) the tows are treated with saturated or overheated steam at high temperature and pressure and simultaneously undergo a mechanical stretching operation.

17 Claims, 5 Drawing Sheets

(56) References Cited

U.S. PATENT DOCUMENTS 4,974,431 A * 12/1990 Kyle ..... D06B 19/0035
239/556

* cited by examiner

APPARATUS FOR STRETCHING ACRYLIC FIBRES TOWS IN A PRESSURISED STEAM ENVIRONMENT

CROSS REFERENCE TO RELATED APPLICATION

This application is for entry into the U.S. National Phase under § 371 for International Application No. PCT/IB2016/053350 having an international filing date of Jun. 8, 2016, and from which priority is claimed under all applicable sections of Title 35 of the United States Code including, but not limited to, Sections 120, 363, and 365(c), and which in turn claims priority under 35 USC 119 to Italian Patent Application No. 102015000023930 filed on Jun. 16, 2015.

The present invention relates to an apparatus for stretching acrylic fibres in a pressurized steam environment, in particular for acrylic fibres used as precursors in a carbon fibre manufacturing process.

FIELD OF THE INVENTION

Carbon fibres consist of thin filaments, usually continuous or of a predetermined length, having a diameter in the range of 2,5-12 μm, preferably 5-7 μm, mainly consisting of carbon atoms. The carbon atoms are mutually bonded in a crystalline matrix, where the individual crystals are aligned, to a greater or lesser extent, along the longitudinal axis of the fibre, thus imparting to the fibre a remarkably high resistance compared to its size.

Several thousands of carbon fibres are then joined together to form a thread or a tow, which can then be used as such or woven in a loom to produce a fabric. The obtained yarn or fabric are impregnated with resins, typically epoxy resins and then moulded to obtain composite artefacts, showing a high lightness and resistance.

Carbon fibres represent the transition point between organic and inorganic fibres; as a matter of fact, they are manufactured starting from organic fibres, which are modified via thermo-mechanical treatments and pyrolysis, during which firstly a reorientation of the molecular segments within the individual fibres takes place and thereafter, at higher temperatures, the removal of oxygen, hydrogen and most of nitrogen occurs, so that the final fibre is composed of more than 90% and up to 99% of carbon and for the remainder of nitrogen.

Currently carbon fibres are produced via modification of artificial fibres (industrially rayon, experimentally lignin), synthetic fibres (polyacrylonitrile for at least 90% of the world production, but also PBO and, experimentally, other thermoplastic fibres such as polyethylene), or residues of distillation of oil or tar (bituminous pitch).

STATE OF THE PRIOR ART

In the case of carbon fibres obtained via modification of, polyacrylonitrile (PAN) synthetic fibres, in which field this invention is placed, the starting polyacrylonitrile fibre (the so-called precursor) must be characterized by a suitable chemical composition, by a particular molecular orientation and by a specific morphology, so that a final carbon fibre provided with satisfactory structural and mechanical features may be obtained from the same. The molecular orientation imparted to the source acrylic fibre, by means of different stretching treatments, as a matter of fact positively affects the structural evenness and hence the tenacity and the elastic modulus of the final carbon fibre; however, the stress induced in the fibre during the stretching operations must not be excessively high because in this case structural defects would be introduced, both superficially and within the fibre.

The desired modification of molecular orientation and of morphology of the polyacrylonitrile synthetic fibre is obtained through a mechanical stretching treatment of the fibre at a high temperature. Traditionally, stretching operations of this type are performed in hot water (wet stretching) with subsequent retraction retaining treatment on sets of 12-60 steam-heated rollers on which the fibre is caused to run. Speeds and temperatures of the rollers are controlled, so that the fibre is first progressively dried and subsequently stabilized and caused to collapse. With this last term the filling of the gaps is intended, which micro-gaps are generated within the fibre following the removal of the spinning solvent, by diffusion into the water and subsequent evaporation thereof.

However, apparatuses of the same type as described above, widely in use in the textile industry, do not give satisfactory results when PAN fibres must be used as precursors of carbon fibres, due to the fact that through a wet process it is not possible to achieve the high final stretching ratios required for a good orientation of the molecules, in view of the subsequent processing steps. As a matter of fact, only the plasticizing action of saturated steam at high temperatures (120 to 190° C.) on the acrylic polymer allows to obtain such stretching ratios (1.2 to 4 on the finished and no longer wet stretchable fibre), so achieving the best results in terms of quality of the obtained fibre in view of the requirements of the subsequent fibre oxidation and carbonization steps.

Indeed, several prior patents already proposed to perform stretching operations in a saturated or overheated steam environment. The presence of saturated steam in the stretching area, in fact, allows a very quick and homogeneous latent condensation heat transfer within the fibre tow. At the same time, the water condensing on the same at high temperature has a plasticizing effect on the fibres allowing to increase the stretching ratio without the need to increase the stretching stress to such a level which would introduce structural defects in the fibres. A moderate steam overheating is often adopted to prevent the danger of an early condensation inside the stretching apparatus.

Stretching operations via saturated or overheated pressurized steam are carried out in suitable apparatuses in which the fibres to be treated are caused to run within a chamber supplied with saturated or overheated steam; said chamber comprises steam seals, usually a labyrinth seal, at the fibre inlet and outlet openings, in order to limit steam losses.

In addition to the limitation of steam consumption, the other major issue that should be addressed when designing these apparatuses consists of the accidental chafing contacts which may occur between the travelling fibres and stationary parts of the apparatus, which contacts obviously cause an undesired wear of the fibres due to surface damage, local overheating or increased stress downstream of the contact points. This wear may cause the tearing of individual filaments and this then triggers additional friction and jams which can lead even to the breakage of a whole tow.

Such accidental contacts are related, on one hand, to the need to keep as low as possible the size of the stretching chamber and related access openings, in order to reduce the overall mass of steam required for the treatment of the fibres and to decrease the steam flow rate coming out from the seals arranged at said openings; and on the other hand, to the fact that the overheating of the apparatus causes arching and twisting thereof making these accidental contacts easier when considering the very small gaps between the travelling tow and the walls of the stretching chamber confining the same.

WO2014/199341, in the name of the same Applicant, discloses an apparatus with a rectangular section, low height stretching chamber provided with a particularly innovative structure, thanks to which all the inconveniences faced by the prior art apparatuses have been resolved. A detailed analysis of the prior art was disclosed in the aforementioned patent, which is referred to herewith in its entirety as a supplement to the present description.

The apparatus disclosed in the above mentioned PCT publication is characterized by the fact that the parallelepiped-shaped stretching chamber, is formed inside a metallic stretching chest, free to expand lengthwise and widthwise within a surrounding rigid and pressure-resistant supporting structure, which supporting structure precisely defines the position of said stretching chest in the height direction thereof.

Thanks to this innovative construction, the stretching chest is free to expand, as a result of the high heating induced by the steam, without undergoing any deformation, arching or twisting, and so allowing to form a stretching chamber having a small volume and a very low opening height. This construction allows a strong reduction of the steam consumption, i.e. of the steam coming out from the opposite ends of the stretching chest, without causing any risk of accidental contacts of the moving tows with the apparatus walls, which apparatus in fact maintains a perfect alignment of its components even during the heating induced by the stretching treatment, thanks to the particular structure described above.

In the above apparatus, the stretching chest is composed of two overlapping halves, mutually hinged along one of the longitudinal edges of the apparatus, so that tow drawing-in can be operated in an open apparatus, thus accomplishing a tremendous simplification, in relation to the prior art apparatuses—both of the type with round stretching chamber and of the type with rectangular stretching chamber—wherein tow drawing-in should be made in a closed apparatus and by operating from one end thereof.

The above mentioned patent also discloses a device for drawing-in tows that may got broken while being processed; this device allows to carry out the drawing-in of the broken tows without interrupting the flow of the undamaged tows. However, while this device works perfectly from the mechanical point of view, problems arise in its use when the drawing-in of the broken tow is made while the apparatus is under steam pressure. As a matter of fact, since the head of the broken tow which is reinserted into the apparatus meets in the first half of its path a strong steam stream flowing in the opposite direction, it is very difficult to bring to end the drawing-in operation without tearing at least a part of the filaments forming the tow and spreading them inside the apparatus, in particular in the steam seals, so causing the apparatus to get soiled and possibly damaging the adjacent tows.

To proceed with the operation of drawing-in a broken tow in safety conditions, it is therefore necessary to wait for the conclusion of a production batch and then stop the delivery of steam, so interrupting the production. This drawback is, however, perfectly acceptable—considered the extraordinary benefits offered by the above said apparatus—when processing carbon fibres of standard type, i.e. carbon fibres wherein the stretching level of the fibres remains well below their breaking point, and then the breakage of the tow is a fairly rare occurrence not causing a significant economic trouble due to the above mentioned production shutdown.

In case of carbon fibres having very high performances, typically those intended for aerospace applications, the requested stretching level is instead much higher and often very close to the breaking point of the fibres. Therefore, when processing this type of fibres, the breakage of the tow is no longer an episodic occurrence but it comes within a normal production behaviour, which should be taken into account at the designing stage. The above described apparatus cannot therefore be satisfactorily used in this field of production which is, moreover, a very interesting sector in consistent growth.

SUMMARY OF THE INVENTION

The object of the present invention is therefore to provide a stretching apparatus which, while providing all the typical advantages of the apparatus disclosed in WO2014/199341 as mentioned above, also allows to perform the operation of drawing-in a broken tow without interrupting the stretching operations on the other tows simultaneously treated in the apparatus.

This object is achieved, according to the present invention, by a stretching apparatus of fibre tows, in a pressurized saturated or overheated steam environment, having the features defined in the attached claim 1. Further preferred features of the invention are defined in the dependent claims.

BRIEF DESCRIPTION OF DRAWINGS

Further features and advantages of the stretching apparatus of fibre tows in a pressurized saturated or overheated steam environment, according to the present invention, will be more clearly evident by the following detailed description of a preferred embodiment thereof, given by mere way of non-limiting example and illustrated in the attached drawings, wherein.

DETAILED DESCRIPTION OF THE PREFERRED EMBODIMENT

Flat-Tube Stretching Chests

In order to treat several adjacent tows, achieving improved results in terms of efficacy, cost-effectiveness and accessibility, and with the additional opportunity to perform a drawing-in of broken tows without interrupting other tows from being processed, the stretching apparatus of the present invention provides the use of a multiple structure. Said multiple structure consists in several adjacent narrow stretching chests, i.e. being width enough to accommodate inside each respective stretching chamber a single tow having a count from 1K to 100K, preferably from 3K to 24K or, in a wider embodiment, up to 3-4 adjacent tows of the same count.

Figure 1:
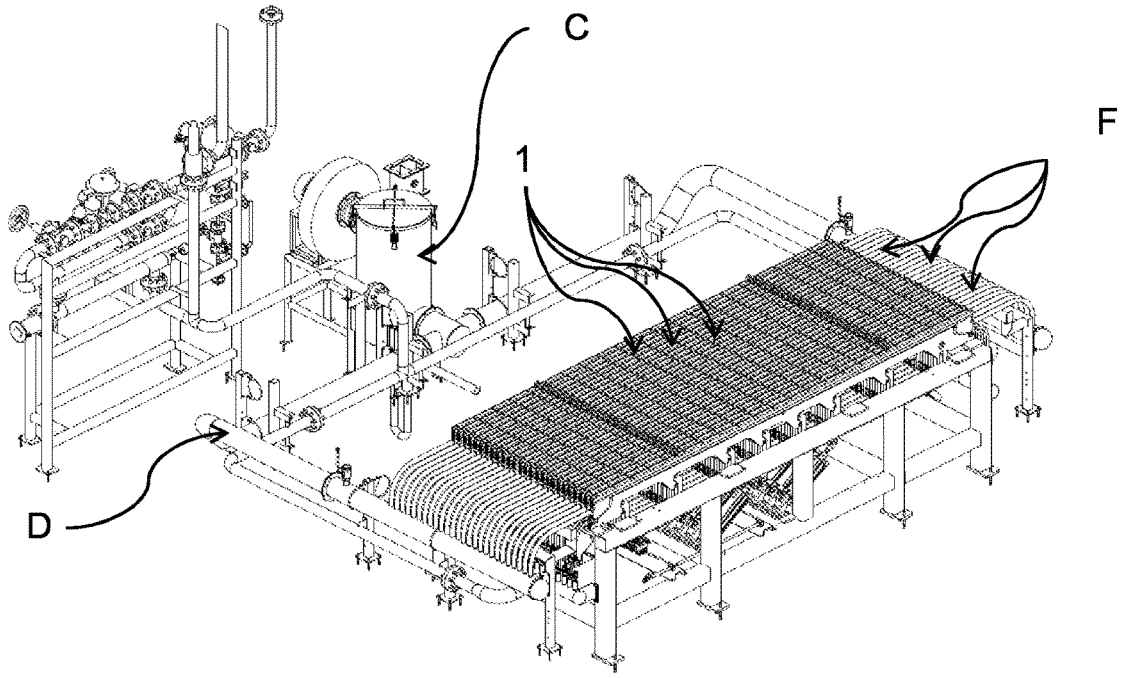
FIG. 1 is an overall perspective view of the multiple stretching apparatus according to the present invention.

Each of the aforementioned stretching chests is made on the basis of the general principles disclosed in prior patent WO2014/199341 as to the features defining the functionality of the stretching chest, but with significant differences as to its opening and closing systems and to the supply of overheated pressurized steam, as better highlighted below. The constituent elements of the stretching chest, entirely designed according to the known structure teachings, will then be described herein synthetically, making reference to the aforementioned patent for any further information on the details regarding their shape and structure. The individual stretching chests are arranged side by side at short mutual distance, for example with a centre to centre distance of 25-120 mm, preferably 40-80 mm, and then with an air gap that separates them, in order to make up the stretching apparatus of the present invention, as schematically illustrated as a whole in FIG. 1. The total number of stretching chests 1 of the multiple stretching apparatus disclosed in the present invention is defined according to the overall cross width of each stretching chest, to the desired productivity, and to the accessibility by the production workers; by way of example, a stretching apparatus may include from 12 to 36 stretching chests 1.

Each stretching chamber 2 of the multiple stretching apparatus of the present invention is thus formed inside a respective stretching chest 1, generally of narrow parallelepiped shape, consisting of two opposite half-chests, respectively an upper half-chest 1*t* and a lower half-chest 1*b*. The lower half-chest 1*b* of the stretching chest is fixed, while the upper half-chest 1*t* can be moved—by means of a particular control mechanism, illustrated in detail below—so as to be quickly lifted and lowered, and give therefore a direct and complete access to the stretching chamber 2 for the operations of tow drawing-in and cleaning of the same chamber. Gaskets are provided in suitable seats formed in correspondence of two opposite longitudinal edges of the half-chests 1*b* and 1*t* of the stretching chest; said half-chests being suitably shaped inside in order to create together a steam stretching chamber 2 having the desired shape.

The internal steam stretching chamber 2 (FIGS. 4 and 5) has a very low height (7-10 mm) and a width strictly necessary (5-100 mm, preferably 20-40 mm) to accommodate the expected number of adjacent tows (1-4), and for this reason it is herein defined as "flat-tube" stretching chamber, in opposition to both round-tube stretching chamber and rectangular stretching chamber of the prior art. This flat tube structure of the stretching chamber allows to have an internal volume of the steam stretching chamber 2 which is comparable or even lower than that of a traditional round-tube stretching chamber processing the same amount of tow; at the same time, the rectangular shape of the stretching chamber 2 allows to house in the same in a perfectly flat position tows up to 100K, in opposition to what occurs in the round-tube stretching chambers where tows of this size necessarily assume an undesired rounded shape; when assuming this shape, in fact, the single filaments of the tow are mechanically stressed in an improper way, causing the occurrence of defects in the final carbon fibre.

The flat-tube structure of the stretching chamber 2 also allows to achieve other advantages, particularly in relation to the steam seals at the two opposite ends of the stretching chest. both at the manufacturing stage (due to the lower machining costs) and in operation (thanks to the lower steam losses through the fibre inlet and outlet openings). Manufacturing the pressure seals of the round section stretching chests is in fact a very complicated matter, while in the flat-tube stretching chest of the present invention, such seals are manufactured in a very simple way—as already disclosed in prior patent WO2014/199341 to which reference is made for constructional details—by means of an ordinary machining of the inner surface of the two opposed half-chests 1*t* and 1*b* of the stretching chest. In summary, this machining process involves forming a series of symmetrically opposed parallel grooves, having a perpendicular direction in respect of the running direction of the tows, which parallel grooves therefore form a sequence of deeper compartments, separated by constrictions at the opposed areas devoid of grooves.

The round-tube stretching chambers finally have the very significant disadvantage that they cannot be opened, in opposition to the flat-tube chambers of the present invention, causing difficulties and loss of time both during the tow drawing-in operations and during the cleaning operations after the breakage of a tow.

To obtain an highly even temperature inside the steam stretching chamber 2 ($\Delta T° \leq 1°$ C.), the two half-chests of the stretching chest 1 are formed with a high thermal conductivity metal. The aluminium, or aluminium-based light alloys, are materials suitable to this purpose, because they combine excellent thermal conductivity, good mechanical characteristics and a low specific weight.

Supporting Structures of the Stretching Chests

As mentioned in the introductory part of the present description, the steam stretching chamber 2 must contain pressurized saturated or overheated steam at high temperature; the standard conditions inside the chamber 2 may therefore vary in a temperature range of 120-190° C. and in a pressure range of 1-10 bar. Preferably, optimum working conditions are between 140 and 165° C. (2.5 to 6 barg), although operating temperatures, and resulting pressures, out of the field indicated above may still be needed for particular recipes of the processed PAN precursor comprising special copolymers. At these temperature and pressure conditions, the stretching chest 1 must be adequately supported so that the two half-chests forming the same may remain steadily in mutual contact in the desired position, despite the high load on the internal walls of the said half-chests determined by the internal pressure of the steam, in the opening direction of the stretching chest 1.

therefore, similarly to what disclosed in the aforementioned prior patent, it is provided a rigid structure supporting the stretching chest 1 which, whilst enabling the maintenance of a predefined position of the two half-chests 1*t* and 1*b* of the chest 1 with respect to its opening direction (z axis, or direction perpendicular to the running plane of the tows), allows a mobility of the two half-chests forming the chest 1 along the longitudinal direction (x axis), sufficient to allow its thermal expansion in this direction. Unlike what disclosed in the above mentioned patent, it is no longer necessary here to provide a chest mobility also along the third axis y, i.e. the transverse axis in the horizontal plane, since the small width of the stretching chest in this direction renders completely negligible the extent of the thermal expansion in this direction, which expansion is in any case absorbed by the elastic deformation of the seal positioned between the two half-chests of the chest 1.

Since this supporting structure has a greater structural rigidity than that of the stretching chest 1, it is capable of forcedly maintaining planar the stretching chest 1 preventing that the internal stresses due to the thermal expansion, which arise during apparatus operation, may cause arching and twisting of said stretching chest. Finally, the small size of the stretching chest and the air gap that separates a stretching chest from the adjacent one in the multiple apparatus, allow an excellent disposal of the heat produced in the stretching chest by the continuous introduction of steam at high pressure and temperature, so that it is possible to avoid significant transfers of heat from the "hot" chest 1 to the relative supporting structure and to maintain this latter at a "cold" temperature, i.e. a temperature next to the room temperature, with the further option of interposing a layer of a thermal insulating material between the above said two elements; therefore, the "cold" supporting structure does not show any significant issue of thermal expansion.

The supporting structure of each one of the stretching chests 1 is bilateral and comprises at the lower side a strong support base 3 and, at the upper side, a tightening bar 4, both having the dimensions of width and length substantially equal to those of the stretching chest 1. To be precise, the support base 3 has a slightly lower length than the stretching chest 1 to leave space for the housing of steam distributors devices 5 which are fixed (hanged) to the lower half-chest 1*b* of the stretching chamber 1, at its opposite ends.

The support base 3 consists of a steel plate having a much greater height than width, so that it give the necessary flexural rigidity to the stretching chest 1, taking into account that the base 3 is made integral to the frame of the stretching apparatus only in correspondence of its opposite ends. On the contrary, the tightening bar 4 has a low thickness, well below its width, since its flexural rigidity in the longitudinal direction is ensured by a guide plate 6, integral with the tightening bar 4 in correspondence of one of its side, for example by means of several screws 6*a*. The guide plate 6 extends downwards, adjacent to the support base 3, for the height sufficient to ensure the required flexural rigidity in the longitudinal direction of the tightening bar 4 and also has a guide function of the same tightening bar 4, to cause the opening and closing of the stretching chamber 2, in the way that will be described in detail below.

According to a main feature of the multiple stretching apparatus according to the present invention, the connection between the support base 3 and the tightening bar 4 and the respective lower half-chest 1*b* and upper half-chest 1*t* must be made so that it allows, as already said above, a degree of freedom of the relevant half-chest along the longitudinal x axis, without allowing any displacement of such an half-chest along the transverse y axis. At the same time, such a type of connection must maintain a certain distance between the two half-chests and the respective support elements, in order to limit the transfer of heat to the same, thanks to an adequate air gap thus formed, which acts as a thermal insulator.

This type of connection is therefore preferably obtained, according to the present invention, by means of a plurality of lower guide rods 8 and upper guide rods 9 (preferably made of insulating composite material), respectively fixed on the upper side of the support base 3 and on the lower side of the tightening bar 4, and each provided with a guide head having T-shaped cross section apt to slidingly engage, with a small play, a corresponding rail provided in the two half-chests 1*t* and 1*b*, respectively, in the lower side of the lower half-chest 1*b* and in the upper side of the upper half-chest 1*t*.

The upper side of the support base 3 is ground, during its manufacturing process, in order to provide an already perfect flatness; the corresponding lower guide rods 8 can therefore be fixed directly on that side with standard screw means and the wings of the T-heads of such guide rods result automatically aligned on the same plane. Thanks to the engagement with small play between the wings of the T-heads and the rail formed in the lower part of the half-chest 1*b* (well shown in the sectional view of FIG. 5), the lower half-chest 1*b* therefore remains perfectly aligned during the stretching operation of the apparatus, irrespective of the thermal expansion it undergoes due to its heating. The lower half-chest 1*b* cannot however undergo any transversal deformation (along the y axis) which would be counteracted by the lower guide rods 8, while it is free to expand longitudinally thanks to the sliding of the lower rail on the T-heads of the lower guide rods 8. The height of T-rods finally determines the thickness of the air gap created between the supporting base 3 and the lower side of the lower half-chest 1*b*, which air gap is necessary to limit the heat transfer from the last one to the first one.

In the case of the tightening bar 4, and in view of its particular construction, the flatness conditions cannot be guaranteed by a unitary mechanical processing of this element and are then obtained through an appropriate adjustment during assembly of the tightening bar 4 on the upper half-chest 1*t*. For this reason, the respective upper guide rods 9 are connected to the bar 4 through special bushings 9*a* provided with a double thread with mutually-opposite direction, in order to obtain a very low axial displacement (0.5 mm) of the bush for each complete turn hereof and therefore, a possibility of very accurate fine adjustment. The final anchor position of the upper half-chest 1*t* can thus be adjusted in a micrometric way in correspondence of each point of connection to the tightening bar 4 until the upper half-chest 1*t* takes a perfectly flat shape in relation with the lower half-chest 1*b*.

The above described supporting structure of the stretching chest 1 has been studied by the Applicant with the aim of allowing a free movement of the two stretching half-chests 1*t* and 1*b* along the x axis due to the thermal expansion caused by the heating of the stretching chest at the working temperature. To get better control over the direction in which these thermal expansions occur and to make them consistent between the two half-chests 1*b* and 1*t*, it is also preferable that each of these half-chests is provided with a single fixed point having a set position and that all the other contact points have a frictional resistance in the direction of axis x as low as possible.

This fixed point can be obtained by fixing firmly, for example by welding or screws, the T-head of a single guide rod 8/9 to the respective half-chest 1*b*/1*t*, so that the position of this guide rod becomes the fixed reference point for said half-chest. Preferably such guide rods are the ones arranged at the centre-line of the half-chests, in order to minimize the amplitude of the mutual movement between the rails of the two half-chests and the T-heads of the respective guide rods.

The above described arrangement makes each stretching chest 1 of the stretching apparatus according to the present invention an independent and easy to open unit, thus making it very easy and quick both the initial drawing-in of the tows and the maintenance and/or replacement of the two half-chests 1*b* and 1*t* to adapt the same to different operating processes or to fibres of different materials.

Mechanism Controlling the Opening of Stretching Chest

The opening and closing movement of each stretching chest 1 is obtained by raising and lowering the upper half-chest 1*t* by means of a corresponding movement imparted to the tightening bar 4 via the guide plate 6 fixed thereto. To this purpose, the guide plate 6 is made of a thin steel plate, having a thickness sufficient to form therein several slots 7 provided with an inner stepped edge of reduced thickness on which the T-head of lateral guide rods 10, fixed at regular intervals on the lateral side of the support base 3, is slidingly engaged. The slots 7 are correspondingly spaced along the guide plate 6 and have their longitudinal axes parallel and vertical. By means of this construction it is possible to obtain the lifting/lowering of the tightening bar 4 by acting on the guide plate 6 which, thanks to the coupling between the slots 7 with stepped edge and the T-head of the lateral guide rods 10, is able to move only on a vertical plane. It is worth to note that the additional crosswise bulk determined by the guide plate 6 is very small; for example the thickness of the guide plate 6 may be in the range of 5-10 mm, so that the entire crosswise bulk of a single stretching chest 1 of the multiple apparatus according to the present invention can be comprised, preferably, between 40 and 80 mm, depending on the chosen size of the stretching chest 1, taking into account that the control leverage system of the guide plate 6 is entirely comprised in the thickness of the support base 3, as it is clear from the drawings and from the following detailed description.

Figure 2:
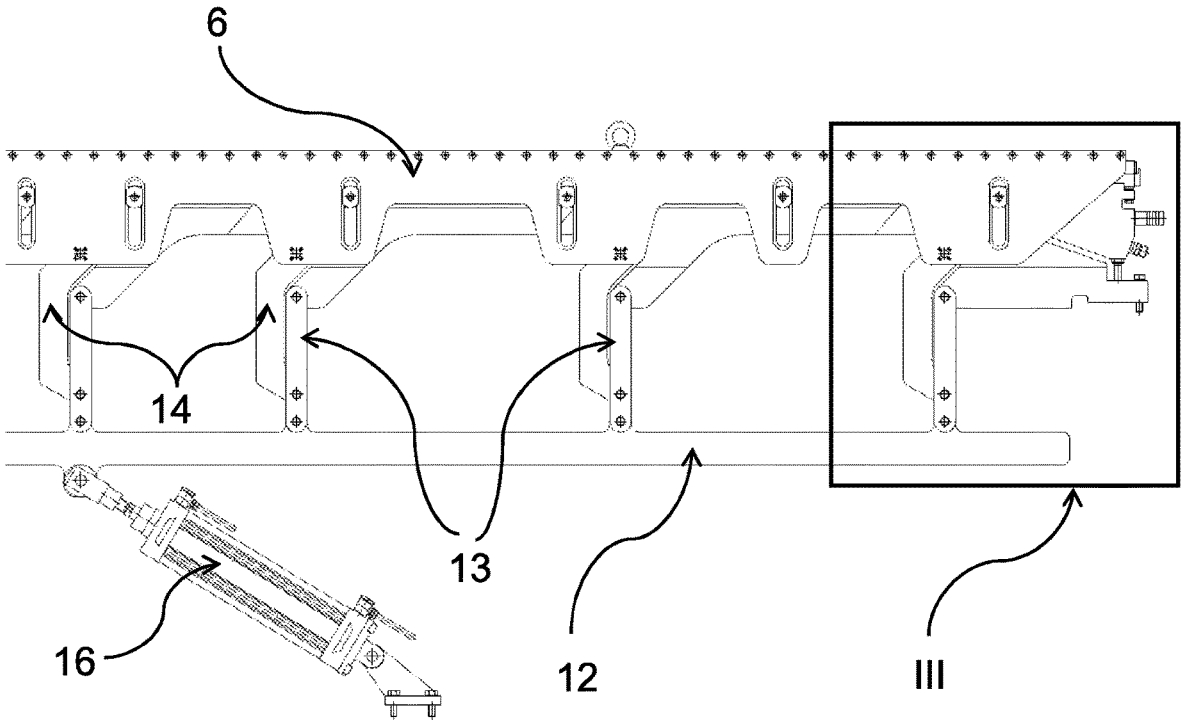
FIG. 2 is an enlarged-scale side view of one half of a flat tube element of the apparatus shown in FIG. 1.
Figure 3:
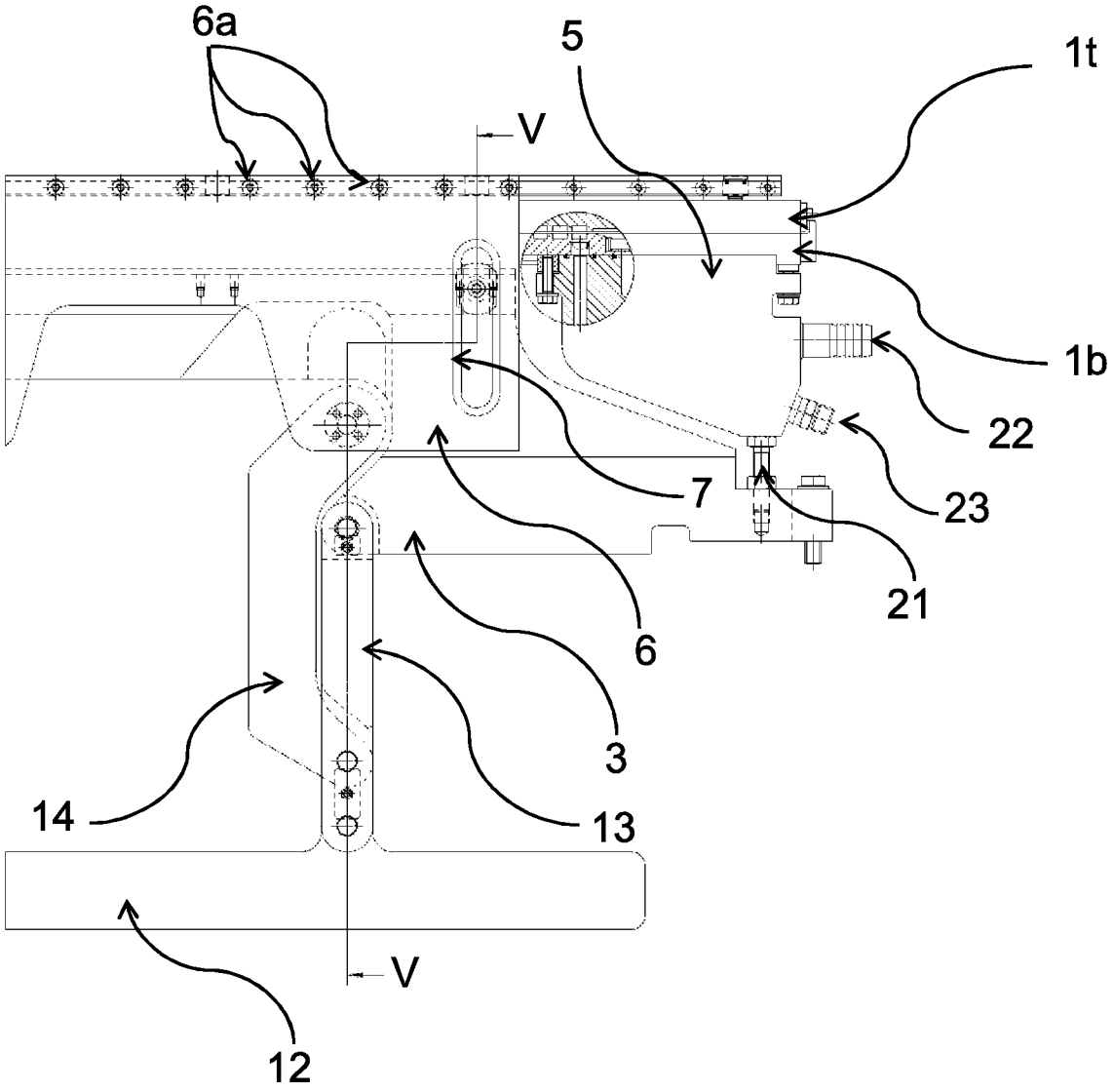
FIG. 3 is a further enlarged-scale side view of the detail enclosed in panel III of FIG. 2, relating to one end of said flat tube element of the apparatus of the present invention.
Figure 4:
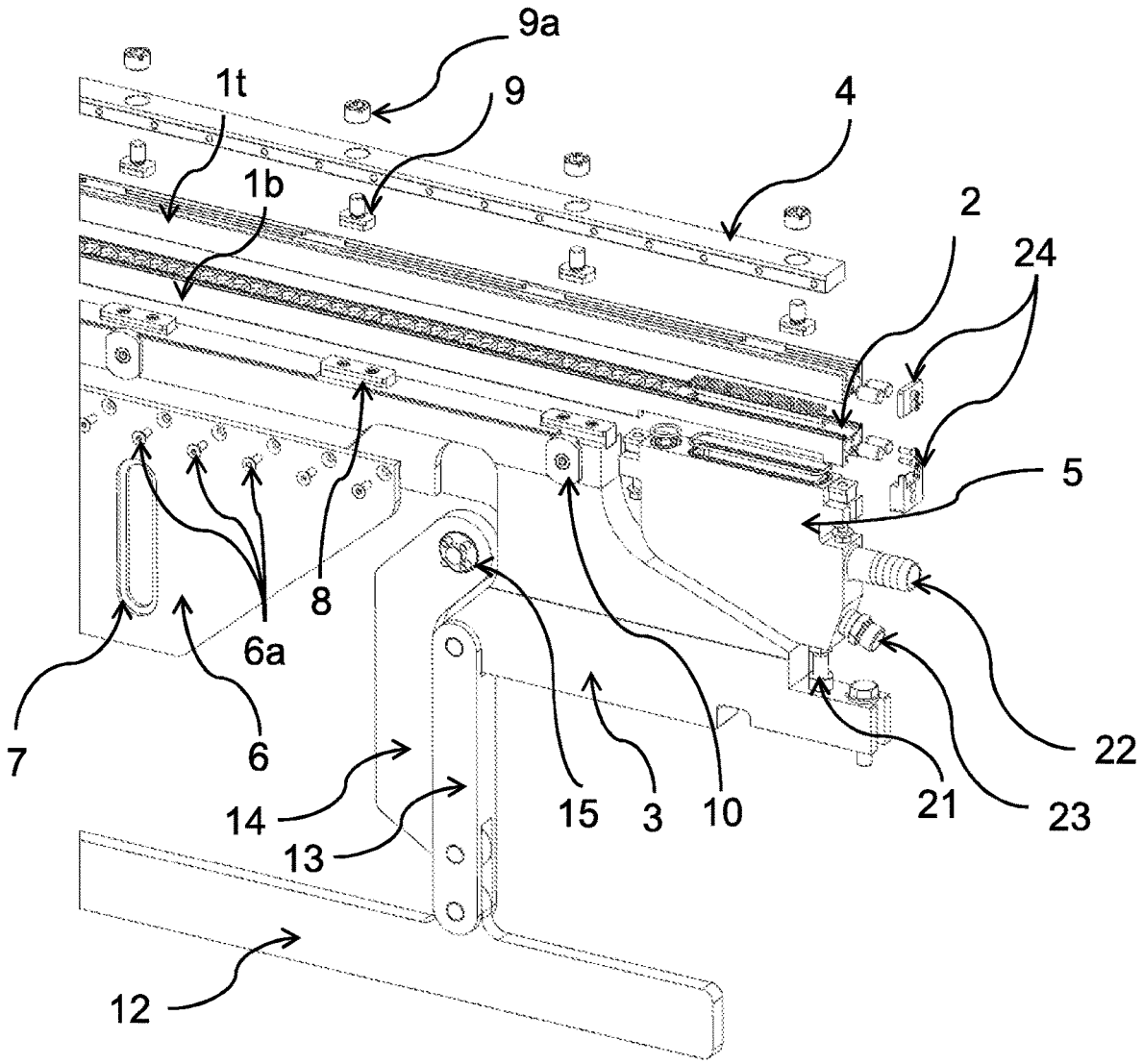
FIG. 4 is a perspective view of the end of the flat tube element shown in FIG. 3.

The raising/lowering movement of the guide plate 6 is obtained via an articulated leverage system clearly illustrated in the overall view of FIG. 2 and, further detailed, in the exploded view of FIG. 4.

Such leverage system comprises a single horizontal tie-rod 12, on which is hinged one end of a plurality of parallel first levers 13 whose other end is hinged to the support base 3. A plurality of parallel second levers 14 has one end hinged in an inner point of a corresponding first lever 13 and the other hinged to the guide plate 6. During their movement the levers 14 are housed in a reduced-thickness recess formed in said support base 3. Thanks to this construction, and according to an important additional feature of the present invention, the entire control leverage system of the guide plate 6 has a crosswise bulk not exceeding the overall crosswise bulk of the stretching chest 1 and of the adjacent guide plate 6, as it looks clearly when examining the sectional view of FIG. 5. Other types of mechanisms allowing to obtain this result, i.e. a reduced bulk with a complete and independent opening of each stretching chest 1 can likewise be used in the stretching apparatus of the present invention; such mechanisms are therefore to be considered equally included within the protective scope thereof.

Figure 5:
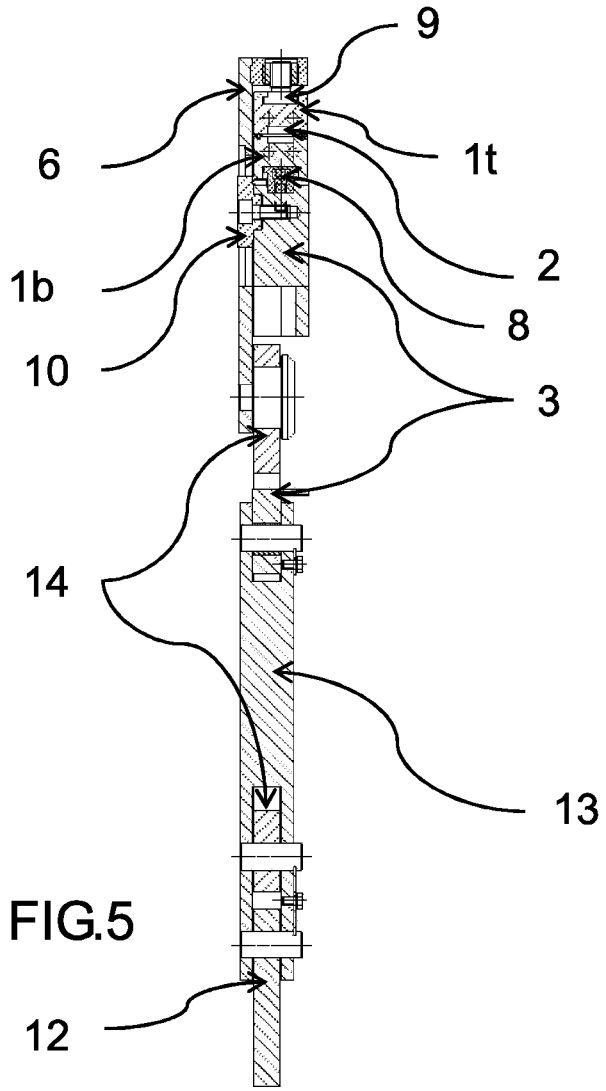
FIG. 5 is a cross-sectional view of the flat tube element of the stretching apparatus according to the present invention, according to the V-V line of FIG. 3.
Figure 6:
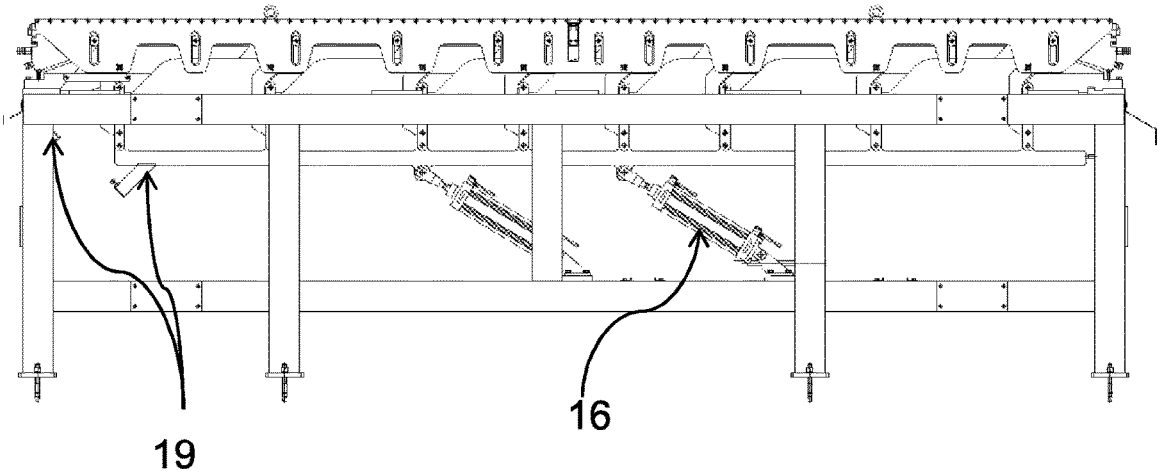
FIG. 6 is an overall side elevation view of the multiple stretching apparatus illustrated in FIG. 1, with flat tube elements shown in a closed position.
Figure 7:
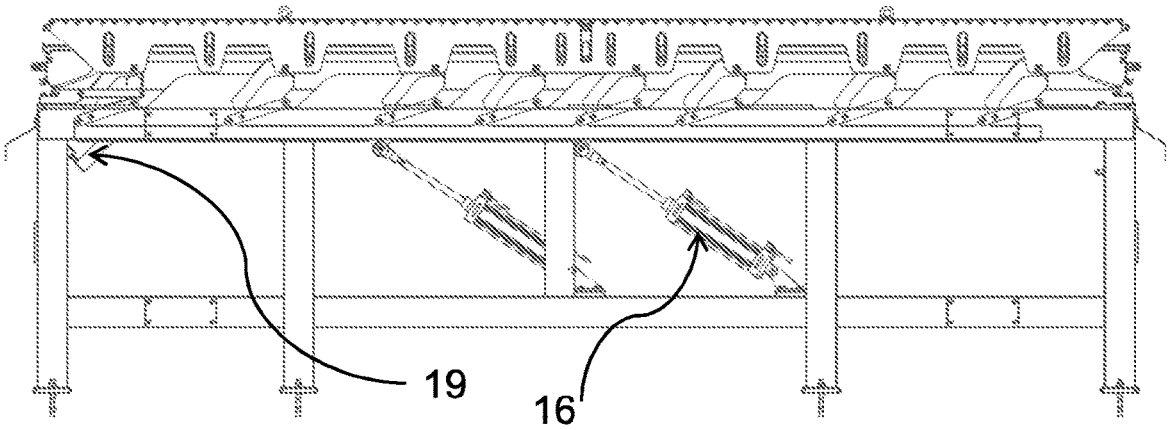
FIG. 7 is an overall side elevation view of the multiple stretching apparatus illustrated in FIG. 1, with flat tube elements shown in an open position.

The combined examination of FIGS. 4 and 5 allows to understand the particular shape of the aforementioned single levers to obtain that the forces they exert are as much as possible centred with respect to the centreline plane of the stretching chest 1, compatibly with the fact that the final movement of the guide plate 6 is necessarily eccentrically with respect to that plan. This provision, however, is merely provided by way of example and other arrangements and configurations of levers are available to achieve the same purpose.

Advantageously, however, the described shape and arrangement of levers, in which the levers 13 are rectilinear and the levers 14 are C-shaped levers, allows to obtain a working position of said lever, i.e. when the stretching chest 1 is closed, in which all hinging points of the levers 13 and 14 are aligned on a single straight line. In this way, when the stretching chamber 2 is pressurized no rotating torque is determined on said levers, which remain in a balanced position. In another (not illustrated) embodiment it is also possible to adopt a leverage system which provides, in said closed position of the stretching chamber 1, a safety position of the leverage mechanism, i.e. a position wherein the aforesaid hinging points are not aligned and determine a moderate torque on the levers 13 and 14 in the closing direction of stretching chest 1, for the purpose of preventing any possible accidental opening of said chest when the stretching chamber 2 is pressurized.

As clearly illustrated in FIGS. 1, 3, 6, and 7, the control movement of the leverage system described above is entrusted to a hydraulic or pneumatic cylinder/piston assembly 16, hinged on one side to the apparatus frame and on the opposite side to the horizontal tie-rod 12. Obviously, each tightening bar 4 is controlled by a relevant cylinder/piston assembly 16 so that, through a suitable control program, all the different side-by-side flat-tube stretching chests 1 in the apparatus of the present invention can both be opened/closed simultaneously, during the regular start-up or shutdown of the apparatus, and, alternatively, be operated individually, i.e. by acting on a specific stretching chest 1 in which a problem is arisen, in order to allow the resolution of said problem, as for example the replacement of a broken tow, without interrupting the processing of the tows undergoing the steam stretching process in adjacent stretching chests. Depending on the spacing of the side-by-side stretching chests in the multiple stretching apparatus of the present invention, it may be preferable to arrange the cylinder/piston assemblies 16 on a single row or alternately staggered in two parallel rows (as illustrated in the drawings).

Depending on the type of the adopted command, hydraulic or pneumatic, and on the plant specific features, the apparatus may be or not equipped with limiting devices 19, for example arranged between the apparatus frame and the horizontal tie-rod 12, or in other suitable positions.

Steam Circuit

The introduction of overheated and pressurized steam in the steam stretching chamber 2 is carried out, as already seen, at the two opposite ends of the stretching chest 1, by means of the two steam distributors 5 which are hanged and fixed to the lower half-chest 1*b* by means of conventional screws. This placement allows that the steam distributors 5 freely follow the thermal expansion movements of the stretching chest 1, also thanks to the fact that the connections of the distributors 5 to the steam distribution system D, fed by the boiler C, take place by means of flexible hoses F. In order to avoid that the weight of the steam distributors 5, even if it is quite low, can cause any inflection of the final part of the lower half-chests 1*b* to which they are hanged—considering that in this position the lower half-chests 1*b* are no longer supported by the support base 3—the lower part of such distributors is provided with a threaded bar 21, adjustable in length, which abuts on a reference plane, projecting from and integral to the frame, on which the threaded bar 21 can slide freely to follow the movements of the stretching chest due to thermal expansion thereof.

Steam distributors 5 are fed in 22 with pressurized overheated steam coming from the boiler C, through the distribution system D and flexible hoses F. At the steam inlet 22, an inner manifold into the steam distributor 5 connects said inlet with one or more longitudinal channels (which can be seen in section in FIGS. 4 and 5) formed in the thickness of the lower half-chest 1*b*. Said channels lead the pressurized steam up to the centreline of the half-chest 1*b*, thus performing the preheating of said stretching chest in order to avoid any risk that condensation water is formed on the running fibres which would be damaged from the same. In this central position, said internal channels open into the stretching chamber 2 within which the known steam stretching process is carried out. The high pressurized steam introduced in central position in the stretching chamber, at high temperature, moves towards the two opposite ends of the stretching chamber 2, passes through the above described steam seals in which the steam pressure gradually decreases, and finally escapes from the entry and exit openings of the tows being processed. A similar steam supply system (not shown) is provided for the upper half-chest 1*t*.

As it appears clearly from an examination of FIG. 4, the pressure seals of the steam stretching chamber 2 does not directly open outside the apparatus of the present invention but end in correspondence of an elongated end cavity of the lower half-chest 1*b*, in fluid connection with a wide empty space below, or suction hood. This suction hood is formed inside the steam distributor 5 and is connected in 23 to a suction fan which maintains a slight negative pressure inside the suction hood, sufficient to prevent steam leaking from the entry and exit openings of the tows, while maintaining a slight flow of air through said openings directed towards the inside of the suction hood. The flow rate of this air flow can be adjusted by choking said entry and exit openings of the tows by means of an adjustable position diaphragm 24, which is applied externally to such openings in a per se known manner. Through the suction inlet 23 is also taken away any possible condensation water collecting in the internal cavity of the steam distributor 5 and adequately conveyed in this position by the inclination of the bottom of said distributor.

Final Considerations

By the foregoing description it appears clearly how the present invention has fully reached the intended object. In fact, thanks to the multiple stretching apparatus comprising more side-by-side stretching chests 1, each having extremely low crosswise bulk, it is possible to associate the relevant benefits of the stretching chamber with rectangular section of the prior aforementioned patent with the flexibility of use of the round-tube stretching chambers, without, however, suffering from the typical disadvantages of this last type of stretching chambers, namely flat tow deformation, very long tow drawing-in operation and great difficulties in stretching chamber cleaning in case of broken tow. Thanks to the fact that the individual flat-tube stretching chests of the multiple apparatus of the present invention can be opened and closed individually, it is now possible to intervene in situations of broken tows without interrupting or otherwise interfering with the processing on the remaining tows and this intervention can be made very quickly, on the contrary to what happens in the round-tube stretching apparatus of the prior art, where the operation of a new tow drawing-in after a tow breakage is so long and complicated that it is necessary to provide normally—in order to avoid excessively long downtime—one or more spare not operating stretching tubes, already prepared for the insertion of a tow.

These remarkable results have been made possible thanks to the adoption of flat-tube stretching chests and a completely innovative opening/closing mechanism of said stretching chests, in which hinges having a transversal axis are provided, instead of the traditional hinges having an axis parallel to the longitudinal axis of the stretching chest, in order to achieve the lifting instead of the tilting of the upper half-chest of the stretching chest, thus allowing a drastic reduction of the space occupied by said mechanism. The technological features already present in the rectangular chamber stretching apparatus according to the prior patent of the Applicant, were also redesigned and harmonized to fit the new design of the stretching chest, without losing any of the positive features of said prior machine, such as the separation of the "hot" stretching chest and relative "cold" supporting structure, the quick opening of the stretching chest, the efficiency of the labyrinth planar seals, the end suction hood of the stretching chamber.

It is understood, however, that the invention is not to be considered as limited by the particular arrangements illustrated above, which represent only exemplary implementations of the same, but different variants are possible, all within the reach of a person skilled in the art, without departing from the scope of the invention itself, which is exclusively defined by the following claims.

The invention claimed is:

1. A stretching apparatus of fibre tows in a pressurized steam environment, comprising a stretching chambers (2) having a generally rectangular section of a low height, within which the tows are treated with saturated or overheated steam at high temperature and pressure and simultaneously undergo a mechanical stretching operation, each of said stretching chamber (2) being formed within a metallic stretching chest (1) consisting of two opposite, mutually facing half-chests, comprising a lower half-chest and an upper half-chest, and being open outwards in correspondence of two transversal edges of the stretching chest (1) through tow entry and exit openings, said half chests (Ib, It) being free to expand in a length direction within surrounding, plurality of rigid and pressure-resistant supporting structures (3, 4, 6) which define a univocal position in a height direction of said half-chests (Ib, It) and being mutually mobile for causing an opening of the stretching chest (1) for an insertion of the tows to be processed, wherein said stretching apparatus comprises a plurality of stretching chests (1) and corresponding rigid and pressure-resistant supporting structures (3, 4, 6) of the plurality of rigid and pressure-resistant supporting structures, arranged side by side, on one or more planes, on a support frame, and in that each stretching chest (1) is provided with a control mechanism (12-15) causing the opening and closing of each stretching chest (1), through the opening and closing of the upper half-chest (it) with respect to the lower half-chest (Ib), independently from the other stretching chests of the plurality of stretching chests (1) of the stretching apparatus.

2. The stretching apparatus as in claim 1, wherein said control mechanism is a leverage system wherein hinges have rotation axes perpendicular to a longitudinal direction of the stretching chest (1).

3. The stretching apparatus as in claim 2, wherein each stretching chamber (2) of said stretching chests of the plurality of stretching chests (1) has a width sufficient to house from 1 to 4 tows side by side in a single running plane.

4. The stretching apparatus as in claim 3, wherein each of said plurality of rigid and pressure-resistant supporting structures (3, 4, 6) are connected to said half-chests (Ib, It) through a plurality of connecting elements (8-9) determining a set position of said half-chests (Ib, It) with respect to a direction perpendicular to a running plane of each tow (z axis) and allowing a limited mobility of said half-chest (Ib, It) in a longitudinal running direction of each tow (x axis), sufficient to allow a free thermal expansion of said half-chests (Ib, It) in the longitudinal running direction of the stretching chest.

5. The stretching apparatus as in claim 4, wherein said connecting elements of the plurality of connecting elements (8-9) consist of T-head, guide rods rigidly fastened to the corresponding rigid and pressure-resistant supporting structures (3, 4) of the plurality of rigid and pressure-resistant supporting structures, T-heads of said guide rods having wings that are engaged and free to slide longitudinally, in corresponding rails formed in said half-chests (Ib, It).

6. The stretching apparatus as in claim 5, wherein each of said rigid and pressure-resistant supporting elements (3, 4, 6) comprise: a) a supporting base (3) connected to the lower half-chest (Ib) and consisting of a steel plate having a width equal to that of said stretching chest (1) and a height greater than said width, which height is sufficient for giving flexural rigidity in a longitudinal direction to said lower half-chest (Ib); b) a tightening bar (4) connected to the upper half-chest (it) and consisting of a steel bar of a width equal to that of said stretching chest (1) and a height smaller than said width; and c) a guide plate (6) integral with said tightening bar (4) in correspondence of a side of the tightening bar and which extends, adjacent to said supporting base (3), for a height for giving flexural rigidity in the longitudinal direction of the stretching chest to said upper half-chest (1*t*).

7. The stretching apparatus as in claim 6, wherein in each one of said two opposite half-chests (Ib, It) of the stretching chest (1), one of said connecting elements (8, 9), determines a set fixed position of said half-chests with respect to the longitudinal direction of the stretching chest (1) (x axis).

8. The stretching apparatus as in claim 7, wherein said guide plate (6) is mobile in a vertical plane along a coupling between a plurality of slots (7) formed in said guide plate (6) and having a vertical major axis, provided with an inner stepped edge with reduced-thickness, and a corresponding plurality of lateral guide rods (10), having a T-head with wings, fastened on a lateral face of the support base (3), the wings of the T-head of said lateral guide rods (10) being slidingly engaged with the inner stepped edge of a corresponding one of said plurality of slots (7).

9. The stretching apparatus as in claim 8, wherein said leverage system comprises: a) a single horizontal tie-rod (12), on which one end of a plurality of parallel first levers (13) are hinged, an opposite end of the plurality of parallel first levers (13) being hinged to said supporting base (3); b) a plurality of parallel second levers (14) pivoted with one end in an inner point of a corresponding first lever of the plurality of parallel first levers (13) and with an opposite end to said guide plate (6).

10. The stretching apparatus as in claim 9, wherein said second levers of the plurality of parallel second levers (14), are housed in a reduced thickness recess formed in said support base (3).

11. The stretching apparatus as in claim 10, wherein said leverage system has an overall crosswise bulk of the stretching chest (1) and of an adjacent guide plate (6).

12. The stretching apparatus as in claim 1, wherein said half-chests (Ib, it) are further provided with gaskets arranged in between respective opposite, longitudinal edges of said half-chests (1*b*, 1*t*).

13. The stretching apparatus as in claim 1, wherein, at opposite ends of the stretching chamber (2), steam distributors (5) are associated to said lower half-chest (Ib), the steam distributors are provided with at least one steam supply manifold and a cavity, said cavity being in connection with said stretching chamber (2) operating as a suction hood of residual steam.

14. The stretching apparatus as in claim 13, wherein said at least one steam supply manifold is connected on one end to a steam entry (22) and on an opposite end to steam supply channels, said steam supply channels being formed within said half-chests (Ib, it) and fluidly connected with a central portion of said stretching chamber (2).

15. The stretching apparatus as in claim 13, wherein said suction hood is connected (in 23) to an external suction device, maintaining a negative pressure within said suction hood.

16. The stretching apparatus as in claim 1, wherein said stretching chest (1) is made of aluminium or of an aluminium alloy and each of said plurality of rigid and pressure-resistant supporting structures (3, 4, 6) are made of steel.

17. The stretching apparatus as in claim 1, wherein each of said plurality of rigid and pressure-resistant supporting structures (3, 4, 6) has a greater structural rigidity than said stretching chest (1), and each of the plurality of rigid and pressure-resistant the supporting structures (3, 4, 6) are therefore able to forcedly maintain planar the stretching chest (1) when the stretching chest is hot, despite the presence of inner stresses due to thermal expansion, which inner stresses would cause arching and twisting of the stretching chest (1) in absence of constraints.

* * * * *